US006085802A

United States Patent [19]

Silberberg

[11] Patent Number: 6,085,802

[45] Date of Patent: Jul. 11, 2000

[54] SHOCK ABSORBING WOVEN WEBBING

[76] Inventor: Abraham A. Silberberg, 20 Holly St., Providence, R.I. 02906

[21] Appl. No.: 09/243,146

[22] Filed: Feb. 2, 1999

[51] Int. Cl.[7] ..... D03D 3/02

[52] U.S. Cl. ..... 139/387 R; 139/388

[58] Field of Search ..... 428/193, 36.1; 139/383 R, 387 R, 388

[56] References Cited

U.S. PATENT DOCUMENTS

| | | |
|---|---|---|
| 4,538,702 | 9/1985 | Wolner . |
| 4,977,647 | 12/1990 | Casebolt . |
| 5,167,263 | 12/1992 | Kelen et al. . |
| 5,174,410 | 12/1992 | Casebolt . |
| 5,436,044 | 7/1995 | Pinkos . |

FOREIGN PATENT DOCUMENTS

| | | |
|---|---|---|
| 1229100 | of 0000 | Canada . |
| 2136915 | 9/1984 | United Kingdom . |

OTHER PUBLICATIONS

DBI/SALA Lanyard Brochure, 1997.
Rose Cobra™ Lanyard Brochure, 1998.

*Primary Examiner*—John J. Calvert
*Assistant Examiner*—Robert H. Muromoto, Jr.
*Attorney, Agent, or Firm*—Wolf, Greenfield & Sacks, P.C.

[57] ABSTRACT

A continuously woven web includes a first woven region interwoven with a plurality of yarns to define a first weave pattern and a second woven region forming a continuous weave with the first woven region and having a continuation of the yarns. The yarns are attached to the second woven region at a distal end thereof. The second woven region has a length defined by a length between a first end positioned adjacent a termination of the first weave pattern and the distal end. In the second woven region, the yarns have a greater elasticity in aggregate and a shorter length than the second woven region. Upon application of a tensile force to the webbing, the yarns in the second woven region may elongate to a length limited by the length of the second woven region.

15 Claims, 8 Drawing Sheets

SHOCK ABSORBING WOVEN WEBBING

BACKGROUND OF THE INVENTION

1. Field of the Invention

This invention relates generally to woven webbing for use in restraint systems, and more particularly to, woven webbing having shock absorption characteristics.

2. Related Art

Woven webbings have been used as straps and slings for various restraint systems such as seat belts for automobiles, harnesses for industrial applications, or tie-downs for securing or supporting various objects. The woven strap is typically formed by weaving a tube from warp yarns and weft yarns, and then flattening the tube to form a two layer woven strap. The two layers are woven together by binder yarns. Stuffer yarns may also be used and are sandwiched between the two layers for increasing the overall strength and/or thickness of the woven strap. Although the strap is useful for securing a variety of objects, it has limited stretchability.

In some situations, it is desirable to provide a strap that includes shock absorbing characteristics. In one typical construction, the strap is alternately folded upon itself and sewn through the folds with a thread that has less strength then that of the woven strap. In a situation where a great amount of force is exerted on the strap, such as may be the case with a falling object or person, or during a rapid deceleration of an automobile for example, the alternating folds of the strap separate due to tearing of the stitching between the alternating folds. Energy is absorbed by the tearing of the stitching, and therefore less energy is transmitted to either the object or the person.

In another typical construction, the strap, which is in the form of a tube, is partially axially collapsed. An elastic member is placed within the collapsed tube and anchored to the tube at its ends. Large forces are absorbed by the expansion of the elastic member within the tube until the length of the elastic member increases to the uncollapsed length of the tube. At that point, the tube prevents continued expansion of the elastic member.

In both of the previously described constructions, secondary operations are required during manufacture of the strap to produce the shock absorbing characteristics. Such secondary operations tend to be more costly. Further, the integrity of the shock absorbing characteristics is limited by the integrity of the labor intensive post-weaving operations of either stitching the alternating folds or anchoring the elastic member at its ends.

SUMMARY OF THE INVENTION

The present invention is a continuously woven webbing having shock absorption that overcomes the above and other disadvantages of conventional constructions. In one particular aspect of the invention, a woven web includes a first woven region interwoven with a plurality of yarns to define a first weave pattern and a second woven region forming a continuous weave with the first woven region and having a continuation of the yarns. The yarns are attached to the second woven region at a distal end thereof. The second woven region has a length defined by a length between a first end positioned adjacent a termination of the first weave pattern and the distal end. In the second woven region, the yarns have a greater elasticity in aggregate and a (shorter length than the second woven region. Upon application of a tensile force to the webbing, the yarns in the second woven region may elongate to a length limited by the length of the second woven region.

In a preferred embodiment, the first woven region comprises a tubular webbing formed into a flattened web when interwoven with the yarns, the yarns thereby serving as binder yarns. The second woven region includes a tubular webbing. The yarns are disposed therewithin as stuffers.

In one embodiment, the yarns are interwoven to the second woven region to define a second weave pattern to facilitate alternately folding the second woven region back upon itself in a serpentine manner to define a longitudinal axis. The yarns are woven through the second woven region substantially along the axis. The first weave pattern is tighter than the second weave pattern. A third woven region may also be included. The third woven region includes a tubular webbing forming a continuous weave with the second woven region. The yarns are disposed therewithin as stuffers.

In another embodiment, the second woven region comprises a tubular webbing. A portion of the first woven region is inserted partially into the tubular webbing of the second woven region such that a portion of the second woven region becomes inverted, doubled upon itself to form a double layer portion.

In still another embodiment, the webbing further includes an intermediate woven region between the first and second woven regions. The intermediate woven region includes a tubular webbing. A subset of the yarns bind together a central region and edge regions of the tubular webbing of the intermediate woven region so as to form a central non-tubular region and two tubular regions along opposing edges. The remaining yarns are disposed within each of the two tubular regions as stuffers. The intermediate woven region is folded along the central non-tubular region to facilitate insertion of at least the intermediate woven region into the tubular webbing of the second woven region.

In a preferred embodiment, the yarns comprise partially oriented yarns. The yarns may be kevlar, nylon or polyester or a combination of each. A first set of yarns may have a first predetermined elasticity and a second set of yarns may have a second predetermined elasticity. The first predetermined elasticity is different from the second predetermined elasticity. Alternatively, at least one yarn may include a material having a different elasticity than the material of any one of the remaining yarns.

In another aspect of the invention, a lanyard is formed with continuous, partially oriented yarns that serve as binders for a flat lanyard and stuffers for a tubular part of the lanyard. The tubular part is inverted, doubled upon itself to form a double layer portion connected to and surrounding a portion of the flat part. Application of a tensile force to the lanyard causes the partially oriented yarn in the tubular part to stretch, enabling the double layer portion to undouble and form a single layer tube.

In yet another aspect of the invention, a lanyard is formed with continuous, partially oriented yarns that serve as relatively tight binders for a flat lanyard, stuffers for a tubular part of the lanyard and relatively loose binders for an intermediate part. The intermediate part alternately folds back upon itself in a serpentine manner to define an alternately folded portion having a longitudinal axis. The yarns loosely weave through the intermediate part substantially along the axis. Application of a tensile force to the lanyard causes the partially oriented yarn in the intermediate part and the tubular part to stretch, enabling the alternately folded portion to unfold.

Various embodiments of the present invention provide certain advantages and overcome certain drawbacks of the conventional techniques. Not all embodiments of the invention share the same advantages and those that do may not share them under all circumstances. Further features and advantages of the present invention as well as the structure and operation of various embodiments in the present invention are described in detail below with reference to the accompanying drawings.

BRIEF DESCRIPTION OF THE DRAWINGS

The invention will now be described, by way of example, with reference to the accompanying drawings, in which.

DETAILED DESCRIPTION

The invention features a webbing having two distinct regions of a continuously woven web. A first woven region is interwoven with a plurality of yarns to define a first weave pattern and a second woven region, forming a continuous weave with the first woven region, includes a continuation of the yarns. The second woven region has a length defined by a length between a first end positioned adjacent a termination of the first weave pattern and a distal end of the second woven region. In the second woven region, the yarns have a greater elasticity in aggregate and a shorter length than the second woven region. Upon application of a tensile force to the webbing, the yarns in the second woven region may elongate to a length limited by the length of the second woven region to provide a shock absorbing or energy absorbing characteristic.

Figure 1:
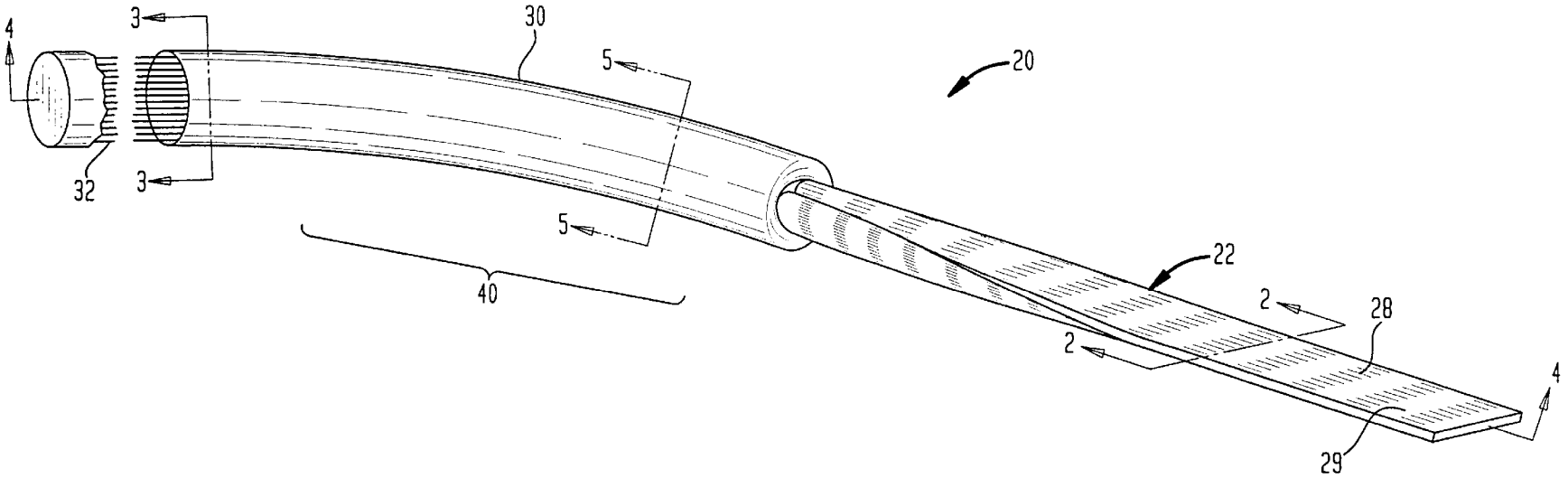
FIG. 1 is a perspective representation of one embodiment of the webbing according to the present invention.
Figure 2:
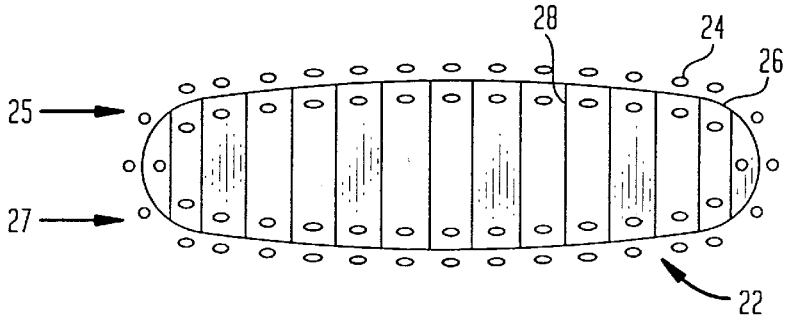
FIG. 2 is a cross-sectional representation of a portion of the webbing taken along line 2—2 of FIG. 1.

The invention is embodied in one particular example shown in FIGS. 1–7. Referring in particular to FIG. 1 (which is a diagrammatic representation of one embodiment of the present invention) and FIG. 2 (which is a cross-section taken along line 2–2 of FIG. 1), woven webbing 20 includes a first woven region or strap 22 formed preferably by continuously weaving a tube from warp yarns 24 and weft yarns 26, and then flattening the tube to form a two layer strap having an upper layer 25 and a lower layer 27. Binder yarns 28 are simultaneously woven to bind the two layers together in a conventional manner resulting in a first weave pattern 29. It should be appreciated that the term "yarn" may include a bundle of individual fibers or a single fiber or a monofilament, or any combination thereof, and may be wound in any suitable pattern.

Figure 3:
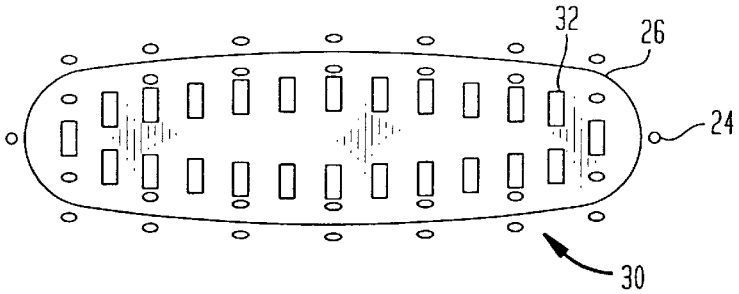
FIG. 3 is a cross-sectional representation of a portion of the webbing taken along line 3—3 of FIG. 1.

As shown in FIG. 1 and FIG. 3 (which is a cross-section taken along line 3—3 of FIG. 1), the webbing further includes a second woven region or tubular webbing 30, which is similarly formed preferably by continuously weaving a tube from the warp yarns 24 and weft yarns 26. In this region, however, the binder yarns 28 are not interwoven with the tubular webbing, rather the yarns form stuffers 32 within the tubular webbing 30. It is important to note that the warp yarns 24 and weft yarns 26 of the strap 22 are the same warp yarns and weft yarns that form the tubular webbing 30. Thus, a continuously woven webbing may be formed.

Upon completion of the weaving operation, the tubular webbing is inverted and doubled upon itself to form a double layer portion 40 (see FIG. 4), with the strap 22 partially inserted into the double layer portion 40 such that the length of the tubular webbing 30, which includes the double layer portion 40, is longer than the length of the stuffer yarns 32. That is, the tubular webbing 30 has a length defined by a length between a first end 41 positioned adjacent a termination of the first weave pattern 29 and a distal end 42. In the tubular webbing 30, yarns have a greater elasticity in aggregated a shorter length than the tubular webbing 30.

The stuffer yarns 32 are then secured to the tubular webbing 30 at the distal end 42 using any suitable means. In addition, the distal end 42 may be folded back upon itself and fastened in a manner to form a loop to attach suitable hardware. Similarly, the distal end 44 of strap 22 may also be folded back upon itself and fastened in a manner to form a loop through which suitable hardware may be attached. Thus, application of a tensile force in a direction shown as arrow F in FIG. 4 simultaneously causes an elongation of the stuffer yarns 32 and an unfolding of the double layer portion 40. The amount of elongation is limited by the length of the tubular webbing 30. The elongation of the stuffer yarns 32 absorbs the energy associated with the application of the force F.

Figure 5:
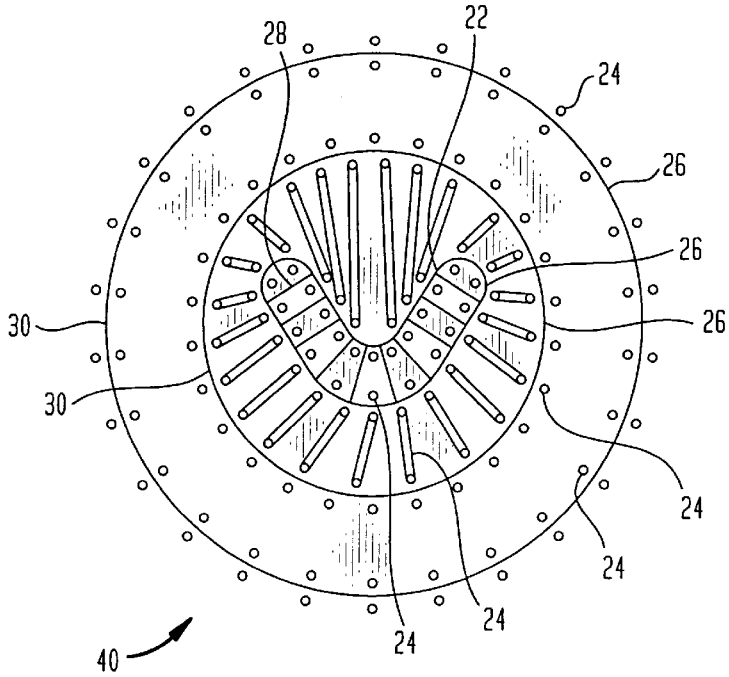
FIG. 5 is a cross-sectional representation of the webbing taken along line 5—5 of FIG. 1.

FIG. 5 is a cross-sectional view taken through 5—5 of FIG. 1 through the double layer portion 40. The cross-section shows the tubular webbing 30 folded and doubled upon itself with the strap 22 inserted therein. To facilitate insertion of the flat portion 22 into the tubular webbing 30, the strap 22 is formed in a substantially V-shaped configuration. The outer warp yarns 24 of the strap 22 forms the inner weft yarns 24 of the tubular webbing 30.

Figure 4:
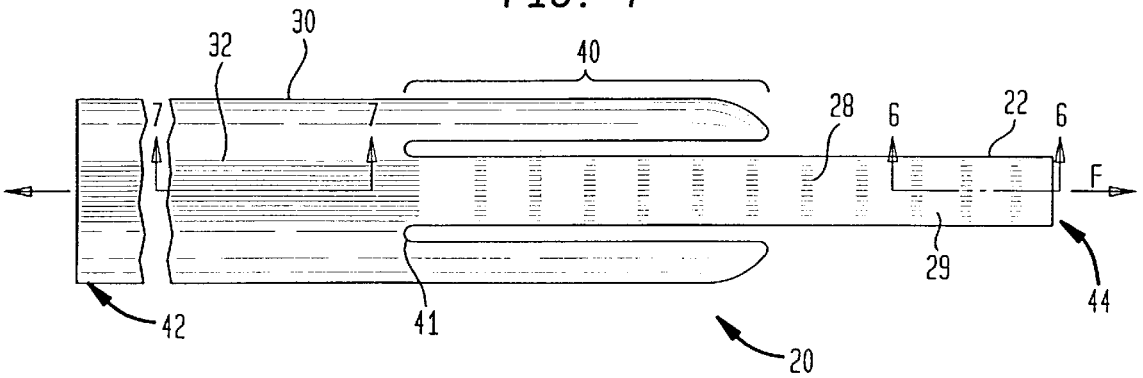
FIG. 4 is a cross-sectional representation of a portion of the webbing taken along line 4—4 of FIG. 1.
Figure 6:
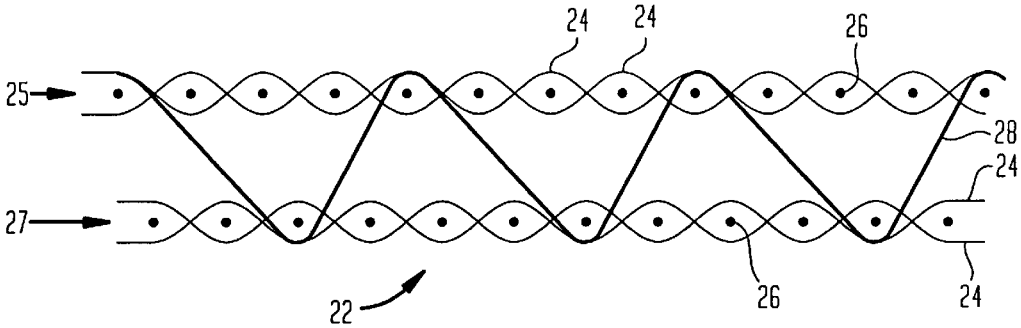
FIG. 6 is a cross-sectional representation of a portion of the webbing taken along line 6—6 of FIG. 4.

FIG. 6 is a cross-sectional view taken along line 6—6 of FIG. 4, which shows the upper and lower layers 25, 27 bound together with the binder yarns 28 to form the strap 22. In this example, the binder yarns 28 are woven to every fourth weft yarn 26, although a tighter or looser weave may be provided. The weaving of the binder yarns 28 to the upper and lower layers provides for increased structural integrity of the strap 22 while simultaneously anchoring the binder yarns 28 thereto. In an alternative embodiment of the present invention, although not shown, the binder yarns 28 may be woven to the upper or to the lower layer only, thereby anchoring the binder yarns 28. Alternatively, some binder yarns 28 may be woven exclusively to the lower layer while others are woven exclusively to the upper layer, also anchoring the binder yarns.

Figure 7:
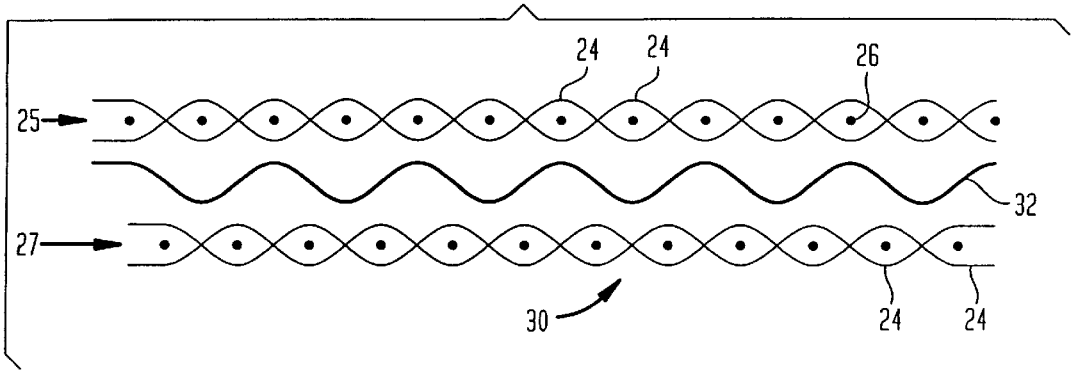
FIG. 7 is a cross-sectional representation of a portion of the webbing taken along line 7—7 of FIG. 4.

Turning to FIG. 7, which is a cross-sectional view taken along line 7—7 of FIG. 4, the binder yarns are no longer woven to either the upper or lower layer. Rather, they are disposed within the tubular webbing 30 as stuffer yarns 32 and are free to elongate therein as a tensile force is applied to the woven webbing 20.

Figure 8:
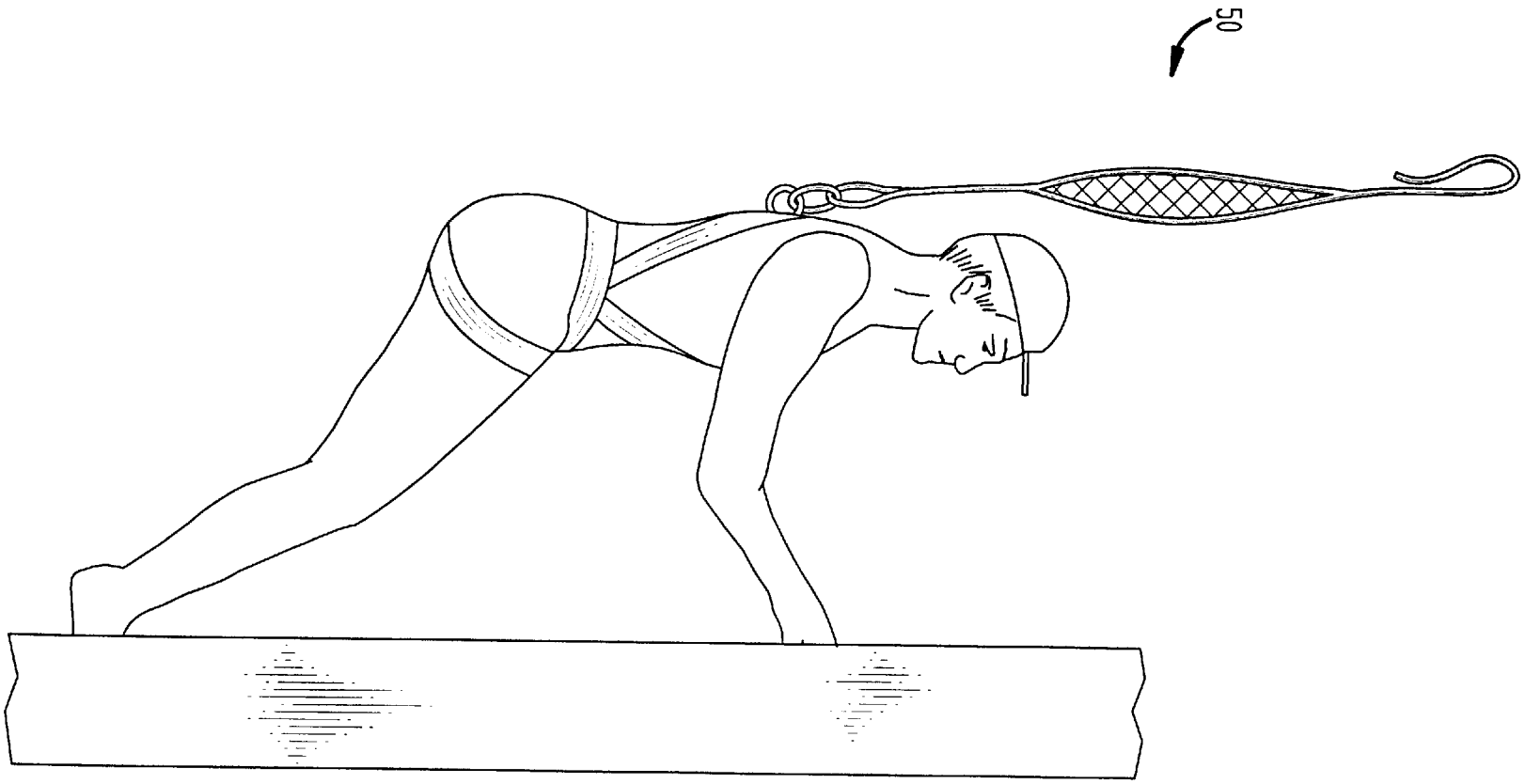
FIG. 8 is a diagrammatic representation of a typical use of the webbing according to the present invention.

The webbing of the invention is particularly useful in situations where shock absorption is required, such as for use with a harness to support a person. However, other applications may include automotive restraint systems, parachute systems, cargo tie-downs, or any other application which requires energy absorption from a rapid deceleration. In any event, in a preferred embodiment, the material used for constructing the webbing should have a strength, aging, abrasion resistance and heat resistance characteristics equivalent to or superior to polyamides. Examples of such materials include kevlar, nylon and polyester or a combination thereof, each having a differing elasticity. In one example of a typical construction, such as the lanyard 50 shown in FIG. 8, the yarns, whether configured as binder yards 28 or as stuffer yarns 32, are preferably partially oriented nylon yarns having a 61% elongation having a minimum load to initiate elongation of 800 pounds. In a preferred construction of the present invention, the woven webbing 20 has a body of 208 ends of 1890 denier nylon 6. 89 ends of 430/5 nylon partially-oriented yarn twisted to 1.5 z are used as the binder/stuffer yarns. Fill of 840 denier nylon 6 and a catch card of 210 denier nylon 6 is also used. The webbing has a width of 1.5 inches, although wider or narrower widths (0.75 inches or 1.25 inches, for example) may be used. In addition, it is possible to provide each region with differing widths, as desired. The length of the webbing is preferably about 99 inches, with a strap length of about 21.5 inches and a tubular webbing length of about 77.5 inches. The webbing preferably has a minimum breaking strength of at least 5000 pounds. The webbing is preferably produced with 22 picks per inch on a Mutronic NFRE loom with 26 harnesses.

When the webbing is complete and removed from the loom, the strap 22 is inserted into the tubular webbing 30 to form a desired length of the double layer portion 40 while pulling out the stuffer yarns 32. The extra length of partially-oriented yarn 32 extending beyond the end of the tubular webbing 30 is cut and discarded. The stuffers 32 may then be attached to the end of the tubular member in any suitable manner. It is to be appreciated that the length of the double layer portion 40, which, in this example, is 10.5 inches, is an important variable in determining the amount of energy absorbed by the partially-oriented yarns. For example, if the yarns are forced to elongate more than 61%, they may break and not fully absorb the energy required to provide adequate shock absorption before the tubular webbing 30 unfolds to carry the entire load.

In a preferred embodiment, the webbing includes a means for indicating that the shock absorbing webbing has deployed, when subject to a static force of 450 pounds, for example. In one particular example, this may be accomplished by inserting a tag into the double layered portion such that upon deployment of the webbing, the tag will become exposed.

Figure 9:
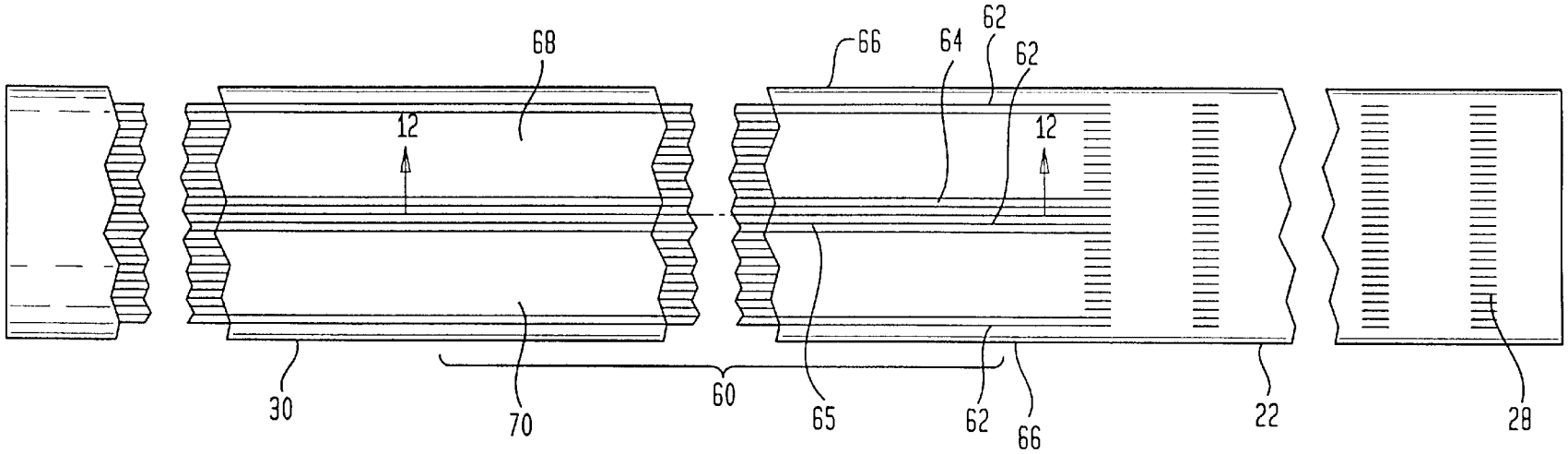
FIG. 9 is an alternative embodiment of the webbing according to the present invention.

In an alternative embodiment, to facilitate insertion of the strap 22 into the tubular webbing 30, an intermediate portion 60 is disposed therebetween. FIG. 9 shows a plan view of such a webbing construction. The intermediate portion 60 includes a tubular webbing having a subset of yarns 62 binding together a central region 64 of the tubular webbing so as to form a central non-tubular region 65. Other yarns 62 bind together lateral edges 66 of the tubular webbing. In a preferred embodiment, double ends of the 1890 denier nylon are woven as binders on the edges and in the central portion. As a result, a central, non-tubular region and tubular regions 68, 70 are formed along opposing edges. The remaining yarns are disposed within each of the tubular regions 68, 70 as stuffers.

Figure 10:
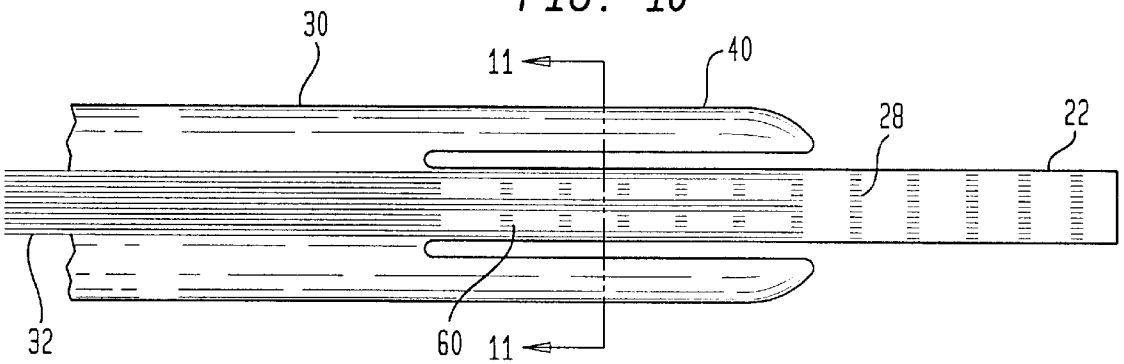
FIG. 10 is a cross-sectional representation of the webbing shown in the inserted position of FIG. 9.
Figure 11:
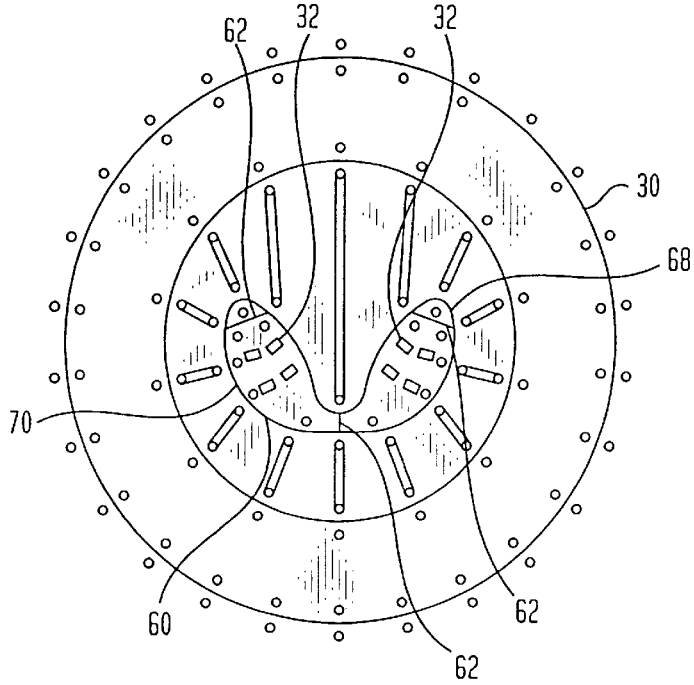
FIG. 11 is a cross-sectional representation of a portion of the webbing taken along line 11—11 of FIG. 10.

The intermediate region may then be folded along the central, non-tubular region 65 to facilitate insertion of at least the intermediate region 60 into the tubular webbing of the second region, as shown in FIG. 10. A transverse cross-section of the insertion of the intermediate portion is shown in FIG. 11. The intermediate portion 60 is shown in a "V" configuration, with the apex of the "V" substantially in the central, non-tubular region. Stuffers 32 are formed in the tubular regions 68, 70 disposed on the edges of the intermediate portion 60.

Figure 12:
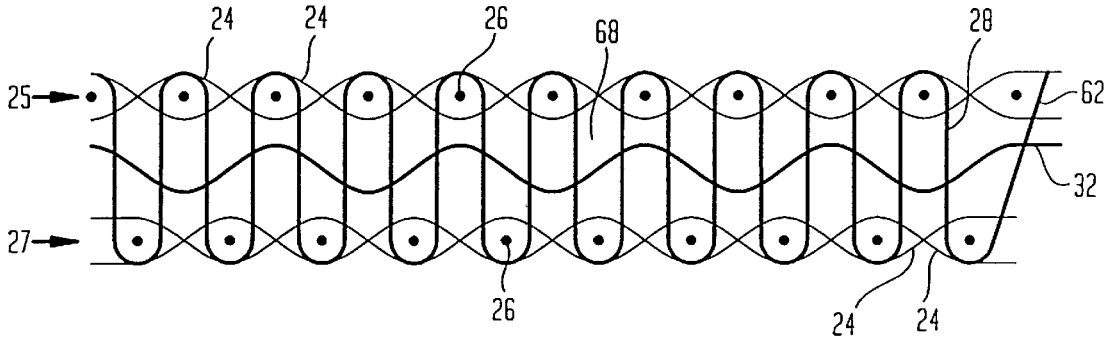
FIG. 12 is a cross-sectional representation of a portion of the webbing taken along line 12—12 of FIG. 9.

A longitudinal cross-section of the intermediate portion 60 is shown in FIG. 12, which is a view taken along line 12—12 of FIG. 9. As can be seen, the central region 64 includes a binder 62 interwoven with the layers 25, 27 and the stuffer 32 extending through the tubular region 68.

Figure 13:
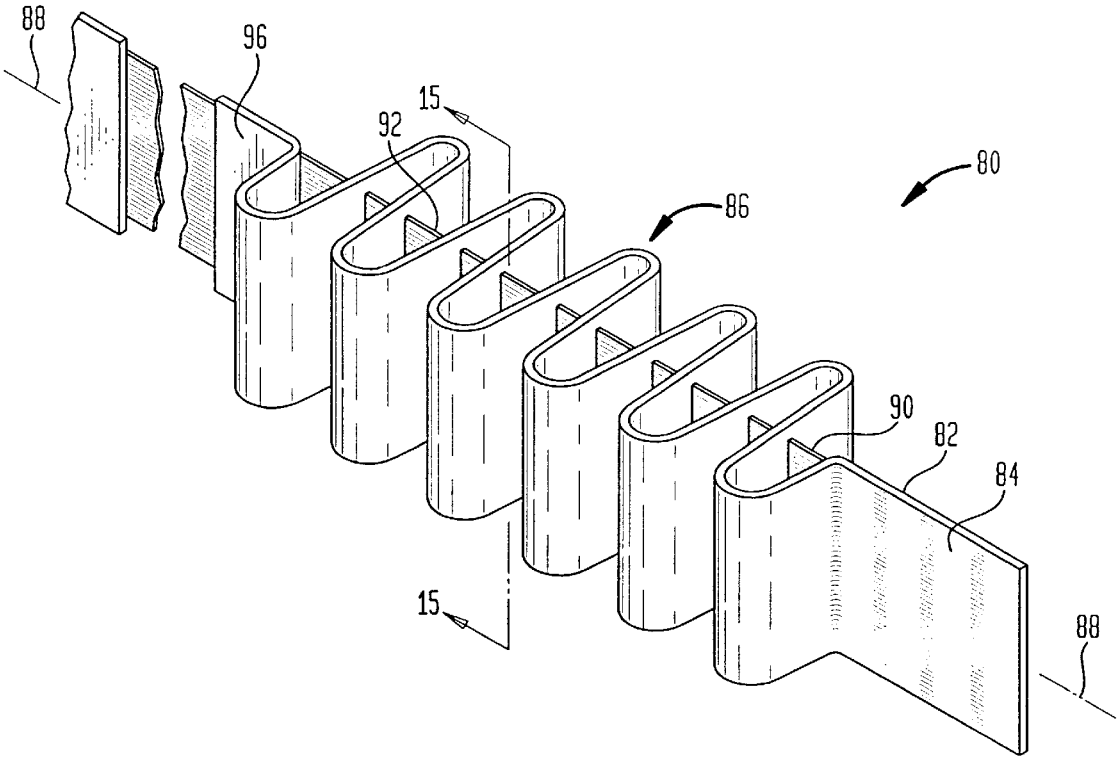
FIG. 13 is another alternative embodiment of the webbing according to the present invention.
Figure 14:
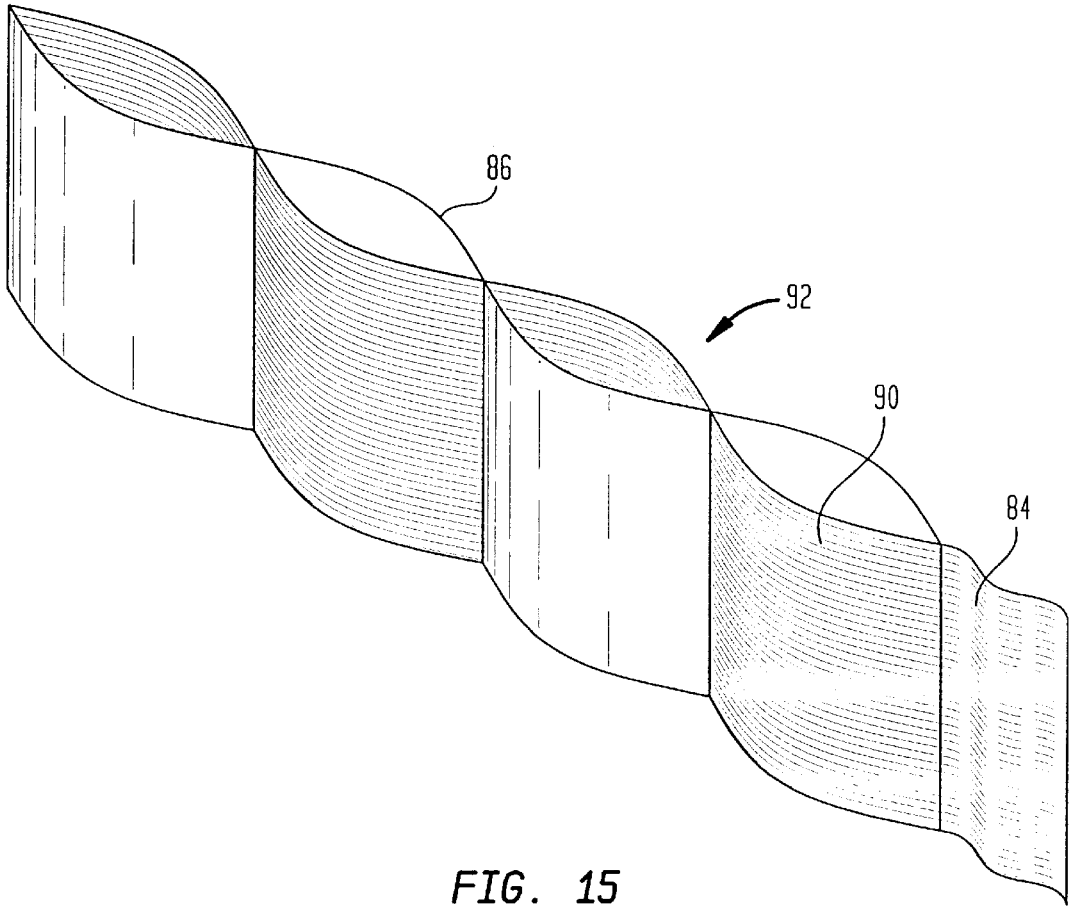
FIG. 14 is a diagrammatic representation of the webbing of FIG. 13 shown in a stretched configuration.
Figure 15:
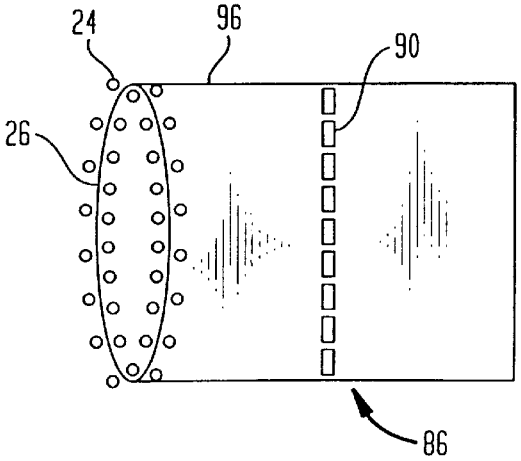
FIG. 15 is a cross-sectional view of a portion of the webbing taken along line 15—15 of FIG. 13.

Turning now to FIG. 13, an alternative embodiment of the present invention is shown. In this example, the webbing 80 includes a first woven region 82 interwoven with a plurality of yarns defining a first weave pattern 84 and a second woven region 86 alternately folded back upon itself in a serpentine manner to define a longitudinal axis 88. The yarns 90, which serve as binder yarns in strap 82, weave through the second woven region 86 substantially along the axis 88. As best shown in FIG. 14, during weaving, the yarns 90 are interwoven into the second woven region 86 to define a second weave pattern 92 such that the first weave pattern 84 is tighter than the second weave pattern 92. When the yarns 90 are pulled through the second woven region 86, the second woven region is collapsed to the alternately folded state as shown in FIG. 13. In addition, as described above, the length of the second woven region or the degree of "tightness" in the weave pattern 92 is an important variable in determining the amount of energy absorbed by the yarns 90. The yarns 90 may be anchored to the distal end (not shown) of the second woven region 86 in a manner described above with reference to FIGS. 1–7. For the sake of completion, as shown in FIG. 15, which is a cross-sectional view taken along line 15—15 of FIG. 13, the second woven region 86 includes a tubular webbing 96 formed in a conventional manner with weft yarns 26 and warp yarns 24. The stuffer yarns 90 pass through the alternating folds along axis 88 as previously mentioned.

While the best mode for carrying out the invention has been described in detail, those skilled in the art to which this invention relates will recognize various alternative embodiments including those mentioned above as defined by the following claims.

What is claimed is:

1. A woven webbing comprising:

a first woven region woven region woven with a first set of yarns and interwoven with a second set of yarns to define a first weave pattern; and, a second woven region woven with said first set of yarns to form a continuous weave with said first woven region woven with said first set of yarns and having a continuation of said second set of yarns, said second set of yarns being attached to said second woven region woven with said first set of yarns at a distal end of said second woven region, with said second woven region woven with said first set of yarns having a length defined by a length between a first end positioned adjacent a termination of said first weave pattern and said distal end, wherein, in said second woven region, said second set of yarns has a shorter length than said second woven region woven with said first set of yarns such that, upon application of a tensile force to said webbing, said second set of yarns in said second woven region may elongate to a length limited by the length of said second woven region woven with said first set of yarns.

2. A webbing according to claim 1 wherein said first woven region comprises a first tubular webbing formed into a flattened web when interwoven with said second set of yarns, said second set of yarns thereby serving as binder yarns, and wherein said second woven region woven with said first set of yarns comprises a second tubular webbing, with said second set of yarns being disposed within said second tubular webbing as stuffers.

3. A webbing according to claim 1 wherein said second woven region woven with said first set of yarns is interwoven with said second set of yarns to define a second weave pattern, with said first weave pattern being tighter than said second weave pattern.

4. A webbing according to claim 3 further comprising a third woven region woven with said first set of yarns comprising a third tubular webbing to form a continuous weave with said second woven region woven with said first set of yarns, with said second set of yarns being disposed within said third tubular webbing as stuffers.

5. A webbing according to claim 3 wherein said second woven region woven with said first set of yarns is alternately folded back upon itself in a serpentine manner to define a longitudinal axis, with said second set of yarns weaving through said second woven region woven with said first set of yarns substantially along said axis.

6. A webbing according to claim 2 wherein in a portion of said first woven region is inserted into said second tubular webbing such that a portion of said second becomes inverted, doubled upon itself to form a double layer portion.

7. A webbing according to claim 6 further comprising an intermediate woven region disposed between said first and second woven regions, with said intermediate woven region comprising an intermediate tubular webbing woven with said first set of yarns and interwoven with a subset of said second set of yarns, thereby serving as binders to bind together a central region and edge regions of said intermediate tubular webbing so as to form a central non-tubular region and two tubular regions along opposing edges.

8. A webbing according to claim 7 wherein remaining yarns of said second set of yarns are disposed within each of said two tubular regions as stuffers.

9. A webbing according to claim 7 wherein said intermediate woven region is folded along said central non-tubular region to facilitate insertion of at least said intermediate woven region into said second tubular webbing.

10. A webbing according to claim 1 wherein said second set of yarns comprises partially oriented yarns.

11. A webbing according to claim 1 wherein said second set of yarns comprises at least one of kevlar, nylon or polyester material.

12. A webbing according to claim 1 wherein said first set of yarns comprises a first predetermined elasticity and a second set of yarns comprises a second predetermined elasticity, with said first predetermined elasticity being different from said second predetermined elasticity.

13. A webbing according to claim 1 wherein at least one yarn of said second set of yarns comprises a material having a different elasticity than the material of any one of the remaining yarns of said second set of yarns.

14. A lanyard with continuous, partially oriented yarns that serve as binders for a flat part of the lanyard and stuffers for a tubular part of the lanyard, a portion of the tubular part being inverted, doubled upon itself to form a double layer portion connected to and surrounding a portion of the flat part, whereby application of a tensile force to the lanyard causes the partially oriented yarns in the tubular part to stretch, enabling the double layer portion to undouble and form a single layer tube.

15. A lanyard with continuous, partially oriented yarns that serve as relatively tight binders for a flat part of the lanyard, stuffers for a tubular part of the lanyard and relatively loose binders for an intermediate part of the lanyard, the intermediate part alternately folding back upon itself in a serpentine manner to define an alternately folded portion having a longitudinal axis, the partially oriented yarns loosely weaving through the intermediate part substantially along the axis, whereby application of a tensile force to the lanyard causes the partially oriented yarns in the intermediate part and the tubular part to stretch, enabling the alternately folded portion to unfold.

* * * * *